US011497965B2

(12) United States Patent
Liu et al.

(10) Patent No.: US 11,497,965 B2
(45) Date of Patent: Nov. 15, 2022

(54) EXERCISE MACHINE USING MOTION SENSOR TO TRACK EXERCISE

(71) Applicant: JIAN LING TECHNOLOGY CO., LTD., Taoyuan (TW)

(72) Inventors: Chen-Ya Liu, Taoyuan (TW); Chin-Yuan Liu, Taoyuan (TW)

(73) Assignee: Jian Ling Technology Co., Ltd., Taoyuan (TW)

( * ) Notice: Subject to any disclaimer, the term of this patent is extended or adjusted under 35 U.S.C. 154(b) by 100 days.

(21) Appl. No.: 16/887,187

(22) Filed: May 29, 2020

(65) Prior Publication Data

US 2020/0376336 A1 Dec. 3, 2020

(30) Foreign Application Priority Data

May 31, 2019 (TW) ..... 108207000

(51) Int. Cl.
*A63B 24/00* (2006.01)
*A63B 21/062* (2006.01)

(52) U.S. Cl.
CPC ..... *A63B 24/0062* (2013.01); *A63B 21/0628* (2015.10); *A63B 24/0087* (2013.01); *A63B 2024/0065* (2013.01); *A63B 2220/40* (2013.01); *A63B 2220/803* (2013.01); *A63B 2225/50* (2013.01)

(58) Field of Classification Search
None
See application file for complete search history.

(56) References Cited

U.S. PATENT DOCUMENTS 5,080,351 A * 1/1992 Rockwell ..... A63B 21/0628 482/100
2006/0084555 A1* 4/2006 Garner ..... A63B 21/4047 482/112
2008/0090703 A1* 4/2008 Rosenberg ..... A63B 24/00 482/8

* cited by examiner

*Primary Examiner* — Sundhara M Ganesan
*Assistant Examiner* — Shila Jalalzadeh Abyaneh
(74) *Attorney, Agent, or Firm* — Rosenberg, Klein & Lee

(57) ABSTRACT

An exercise machine using motion sensor to track exercise, comprising: an exercise equipment, including a mainframe, the mainframe is fixed and won't be moved by user's movement, an operating mechanism, the operating mechanism is arranged on the mainframe and it will follow the movement of the user; wherein the operating mechanism having a motion sensor, inside the motion sensor having a multiple-axis tracking sensor module and a first microprocessor for detecting the height displacement of the operating mechanism and transmitting the height displacement signal to an electronic control device, then processing by a second microprocessor arranged inside the electronic control device to know whether the motion track of the user reach the preset position during exercise to ensure the effect of exercising.

3 Claims, 7 Drawing Sheets

EXERCISE MACHINE USING MOTION SENSOR TO TRACK EXERCISE

BACKGROUND OF THE INVENTION

1. Field of the Invention

The invention relates to an exercise machine, especially to one that using a motion sensor to track exercise.

2. Description of the Related Art

People in modern society always live a fast-paced life, and most people are busy at work and lack of time for exercise, for maintain health body most office workers rely exercise equipment to train their body.

Most of the conventional exercise machines design will set a goal (moving distance) by users' requirement, such as pulling distance or pulling distance. However, the conventional exercise machines are lack of a device for precisely detecting whether do the users achieve the goal. The conventional exercise machines cannot ensure the effect of the exercise.

FIG. 1 is a schematic diagram illustrating a conventional muscle training machine, a common chest press machine. Said conventional muscle training machine M uses iron weight stack S, spring or rubber as exercise load; However, this conventional load structure has below disadvantage:

First, when the user wants to change the exercise load by changing the weight and amount of the iron weight stack S, it takes time and requires user to stop their exercise.

Second, the iron weight stack S is heavy and not easy to adjust the exercise load precisely.

Third, when the iron weight stack S is pulled up by the steel wire Y and dropped, it creates loud noise which not only disturbing but also make people feel uncomfortable.

Although some inventors take oil pressure cylinder or air pressure cylinder as resistance to solve above mentioned problems, oil pressure cylinder and air pressure cylinder still have the problems of not easy to calculate the exercise load.

In addition, with the rapid advancement of technology and the booming economy development, the technology of the motion sensor is also improved, the first generation is the 3-axis G sensor used on Wii and iPhone 2G, the second generation is sensor fusion of 6-axis G sensor plus gyro sensor used on the Air Mouse. The inventor has previously applied these motion sensing technologies to specific body sensing fitness equipment and have received excellent responses.

To solve the disadvantages of conventional exercise machine, the inventor develops an exercise machine using a motion sensor to track exercise.

SUMMARY OF THE INVENTION

It is a primary objective of the present invention to provide an exercise machine using motion sensor to track exercise, the size of the motion sensor is small and does not take up space, by sensing the angle change it can detect whether the users reach the preset position during exercise to ensure the effect of exercising.

In order to achieve the above objective, the present invention includes an exercise equipment, including a mainframe, the mainframe is fixed and won't be moved by user's movement, an operating mechanism, the operating mechanism is arranged on the mainframe and it will follow the movement of the user; wherein the operating mechanism having a motion sensor, inside the motion sensor having a multiple-axis tracking sensor module and a first microprocessor for detecting the height displacement of the operating mechanism and transmitting the height displacement signal to an electronic control device, then processing by a second microprocessor arranged inside the electronic control device to get the motion track of the user.

Furthermore, the present invention further comprising a resistance mechanism arranged on the mainframe and linked to the operating mechanism for providing exercise load, the resistance mechanism include a brake lever, the top end of the brake lever is linked to the tail end of the operating mechanism and forms a moveable first pivot point, and the bottom end of the brake lever is linked to an expansion link of an oil pressure cylinder, the bottom end of the oil pressure cylinder is pivoted to the mainframe and forms a first unmovable pivot end.

Moreover, the operating mechanism further comprises: a curved bar having a first pivot point and a second pivot point, the middle between the two pivot point is pivoted to the mainframe to form a second unmovable pivot end; a connecting rod section formed by a first connecting rod and a second connecting rod, the tail end of the first connecting rod is linked to the second pivot end of the curved bar and forms a movable second pivot point, between the first connecting rod and the second connecting rod forms a movable third pivot point, and the top of the second connecting rod is pivoted to the mainframe and forms a unmovable third pivot end.

Moreover, the motion sensor further comprises a Bluetooth module arranged inside the motion sensor and electrically connected to a first microprocessor, and the Bluetooth module is coupled to an antenna to transmit the motion tracking signal of the curved bar; furthermore, the motion sensor further comprises a power supply unit for providing power to the motion sensor.

Moreover, the electronic control device further comprises a power control unit for controlling the power, a wireless receiving unit for receiving the motion tracking signal sent by the antenna of the Bluetooth module, and a display unit connecting to the second microprocessor.

As stated above, the present invention uses the motion sensor to detect the acceleration while exercising and uses the three-axis gyro sensor to detect angular velocity; And the present invention detect the geomagnetic change to get the lifting height of the operating mechanism to get the absolute coordinate and further knows the exercise track of the user, the size of the motion sensor is small and does not take up space, and it is convenient to use and can precisely sensing the motion track.

DETAILED DESCRIPTION OF THE PREFERRED EMBODIMENT

Figure 1:
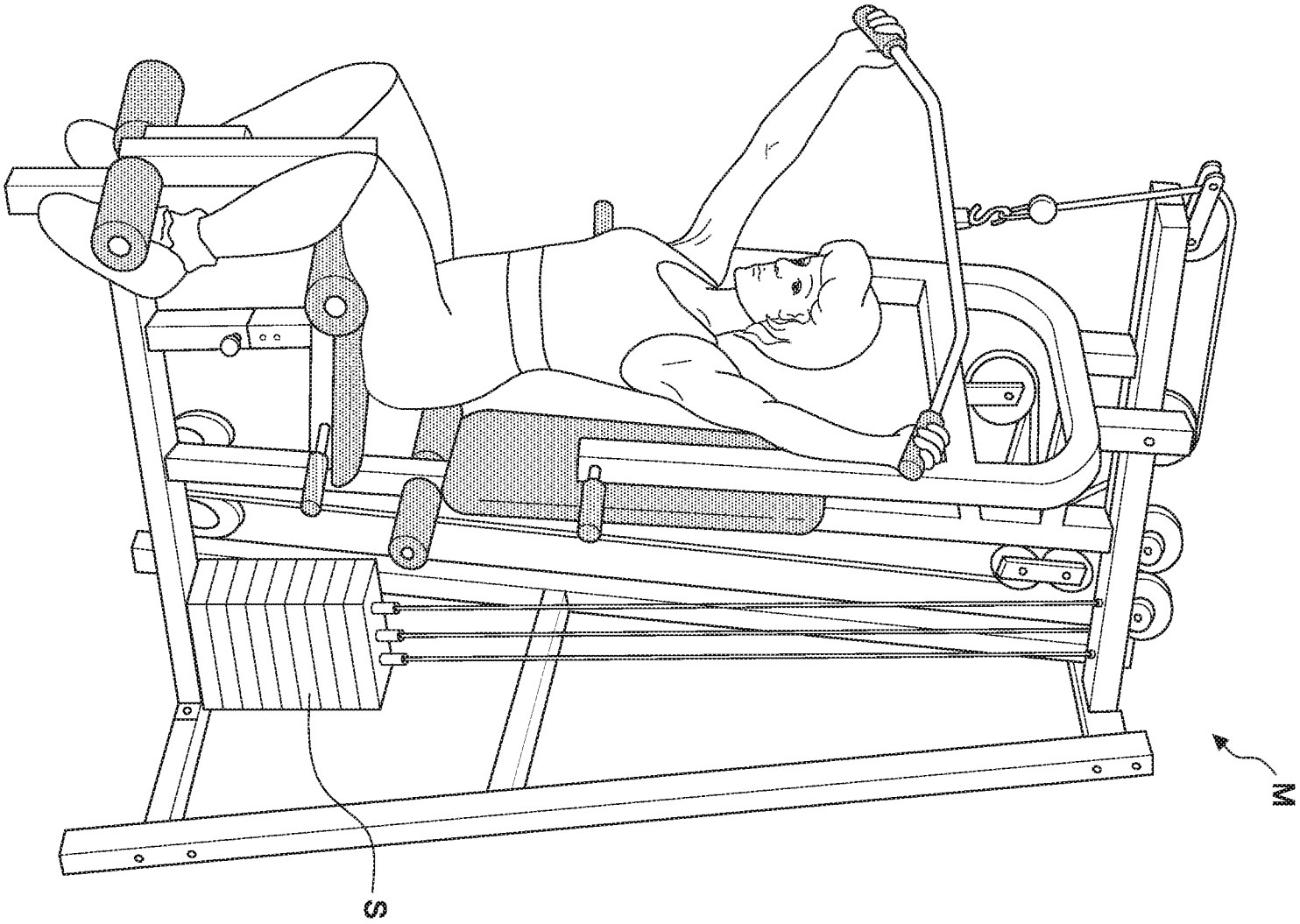
FIG.1 PRIOR ART
FIG. 1 is a schematic diagram illustrating a conventional muscle training machine.
Figure 2:
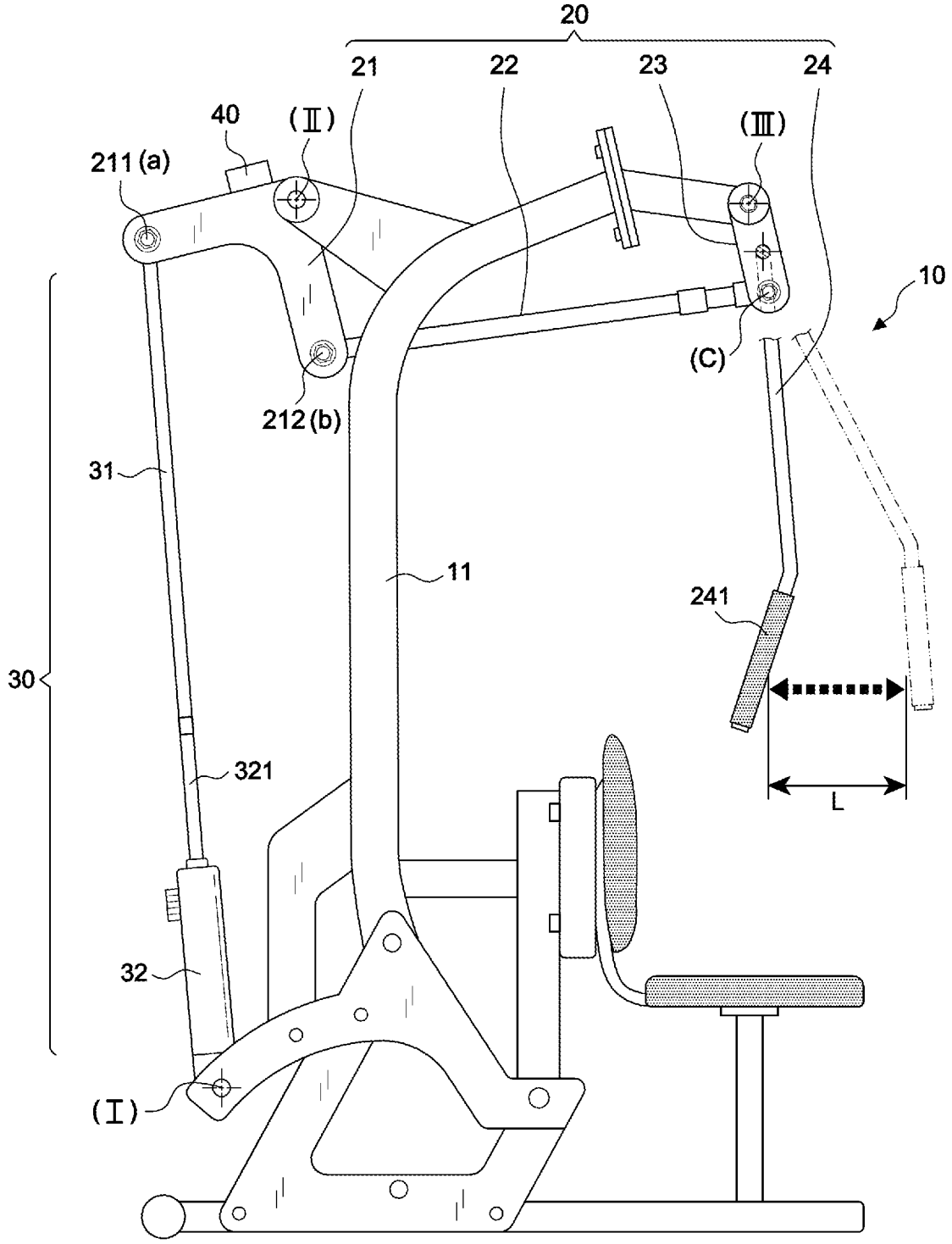
FIG. 2 is a schematic diagram illustrating the structure of the applicable embodiment of the present invention.

The below description and drawing are for descripting the applicable embodiment, but the present invention is not limited to this embodiment. The present invention can be implemented in other embodiments, and well-known steps or elements are not described in detail to avoid unnecessary restrictions on the present invention. It is particularly noted that the drawings are for illustration purposes only and do not represent the actual size or number of components. Some details may not be fully drawn in order to make the drawings concise and clear. The blow embodiment takes a chest press machine as an example, but it is not limited to this. For example, a rowing exercise machine or other fitness and rehabilitation equipment can be also be implemented with the present invention.

Referring to FIGS. 2-5, in this embodiment comprises: an exercise equipment 10, including a mainframe 11, the mainframe 11 is fixed and won't be moved by user's movement, an operating mechanism 20, the operating mechanism 20 is arranged on the mainframe 11 and it will follow the movement of the user, and a resistance mechanism 30 arranged on the mainframe 11 and linked to the operating mechanism 20 for providing exercise load. The resistance mechanism 30 is just an applicable embodiment of the present invention, but the present invention is not limited to such application.

Wherein the operating mechanism 20 having a motion sensor 40, inside the motion sensor 40 having a multiple-axis tracking sensor module 41 and a first microprocessor 42 for detecting the height displacement of the operating mechanism 20 and transmitting the height displacement signal to an electronic control device 50, then processing by a second microprocessor 53 arranged inside the electronic control device 50 to get the motion track of the user.

In this embodiment, the resistance mechanism 30 can include a brake lever 31, the top end of the brake lever 31 is linked to the tail end of the operating mechanism 30 and forms a moveable first pivot point (a), and the bottom end of the brake lever 31 is linked to an expansion link 321 of an oil pressure cylinder 32, the bottom end of the oil pressure cylinder 32 is pivoted to the mainframe 11 and forms a first unmovable pivot end (I).

In this embodiment, the operating mechanism 20 comprises: a curved bar 21 having a first pivot point 211 and a second pivot point 212, the middle between the two pivot point is pivoted to the mainframe 11 to form a second unmovable pivot end (II); a connecting rod section formed by a first connecting rod 22 and a second connecting rod 23, the tail end of the first connecting rod 22 is linked to the second pivot point 212 of the curved bar 21 and forms a movable second pivot point (b), between the first connecting rod 22 and the second connecting rod 23 forms a movable third pivot point (c), and the top of the second connecting rod 23 is pivoted to the mainframe 11 and forms a unmovable third pivot end (III); a driving rod 24 having a free end 241 be drove by the user's movement to move, and the other end is linked to the connecting rod section 22,23 for driving the connecting rod section.

Figure 3A:
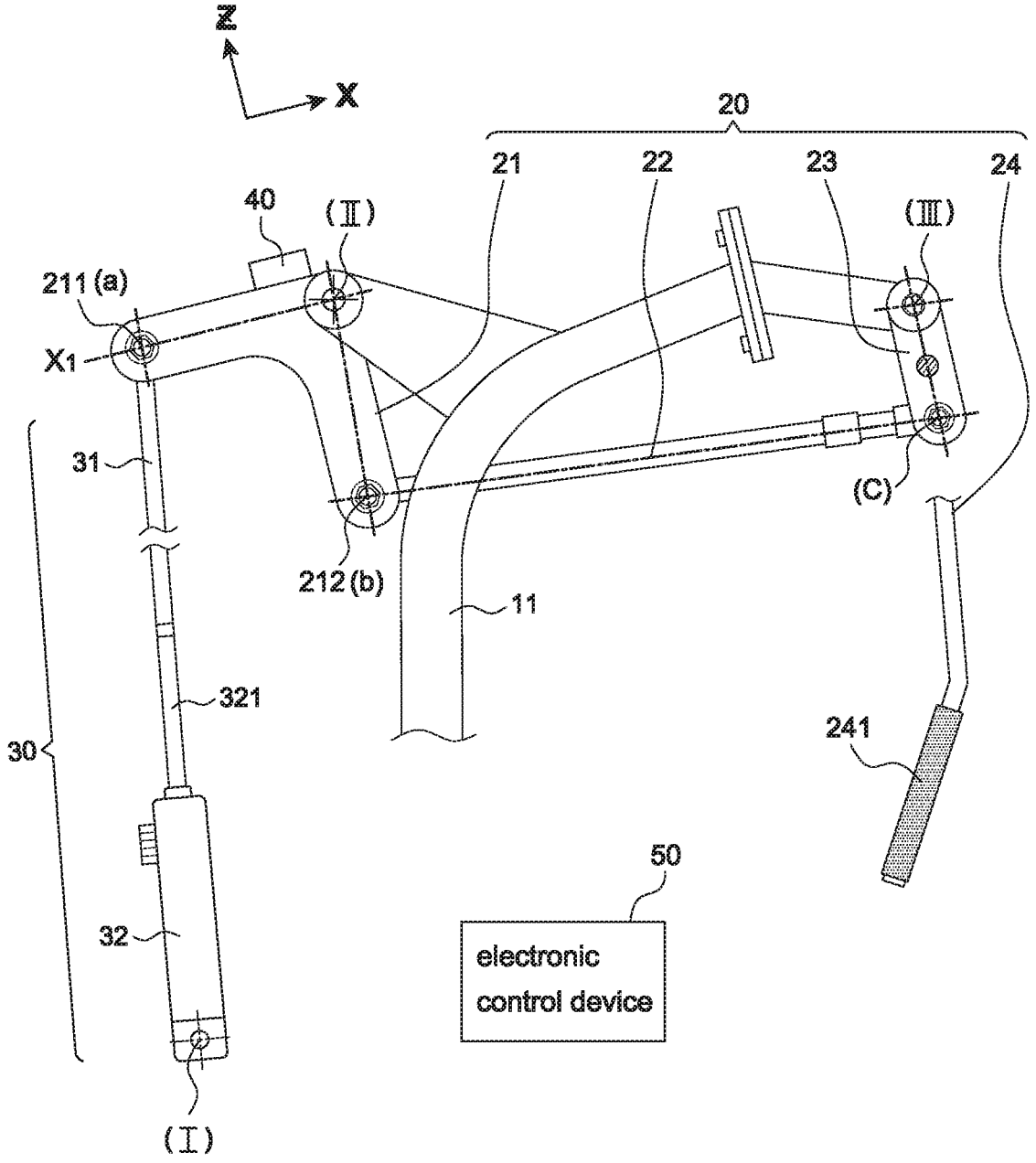
FIG. 3A is a first schematic diagram illustrating the motion tracking of the applicable embodiment of the present invention.
Figure 3B:
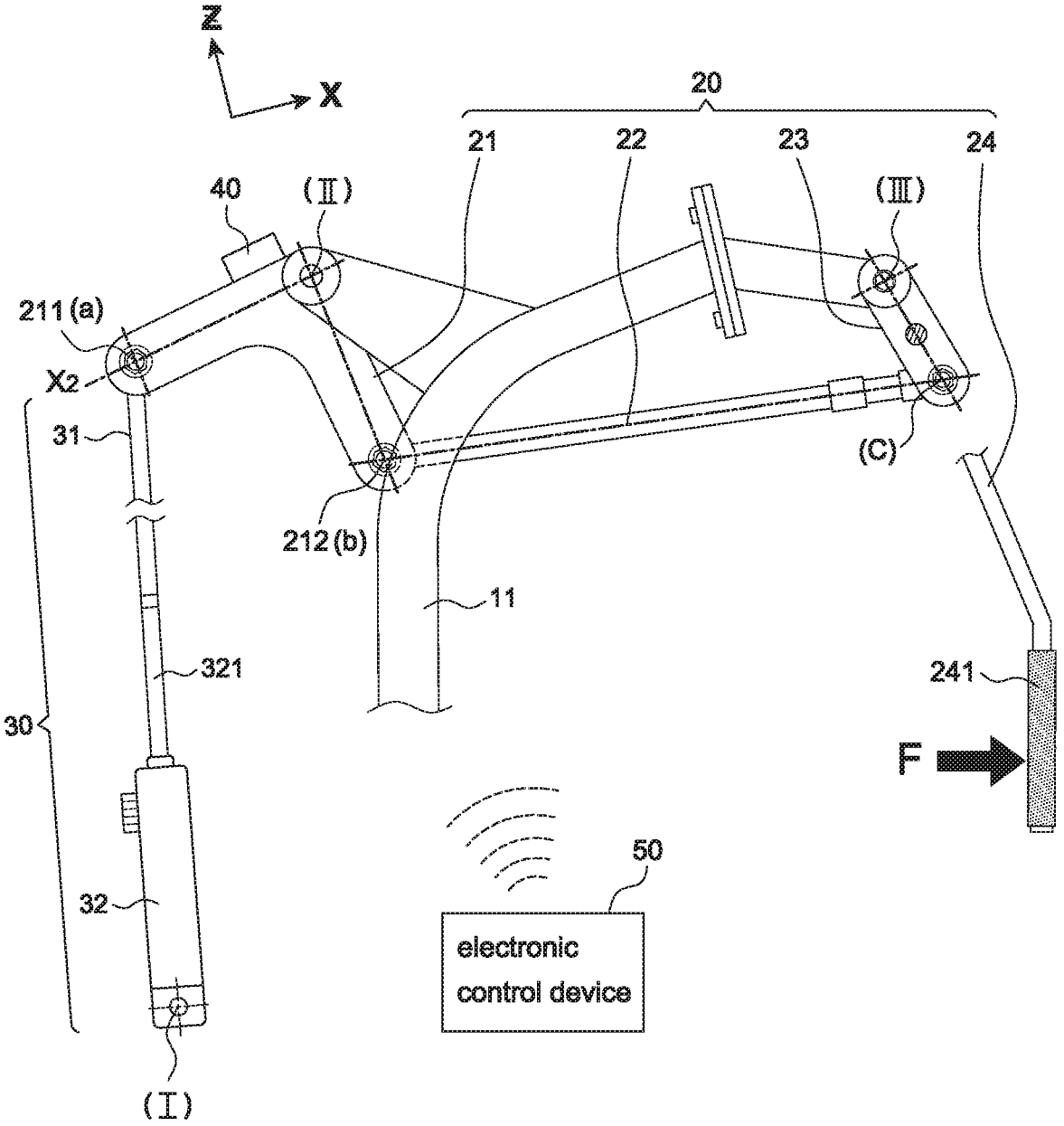
FIG. 3B is a second schematic diagram illustrating the motion tracking of the applicable embodiment of the present invention.
Figure 3C:
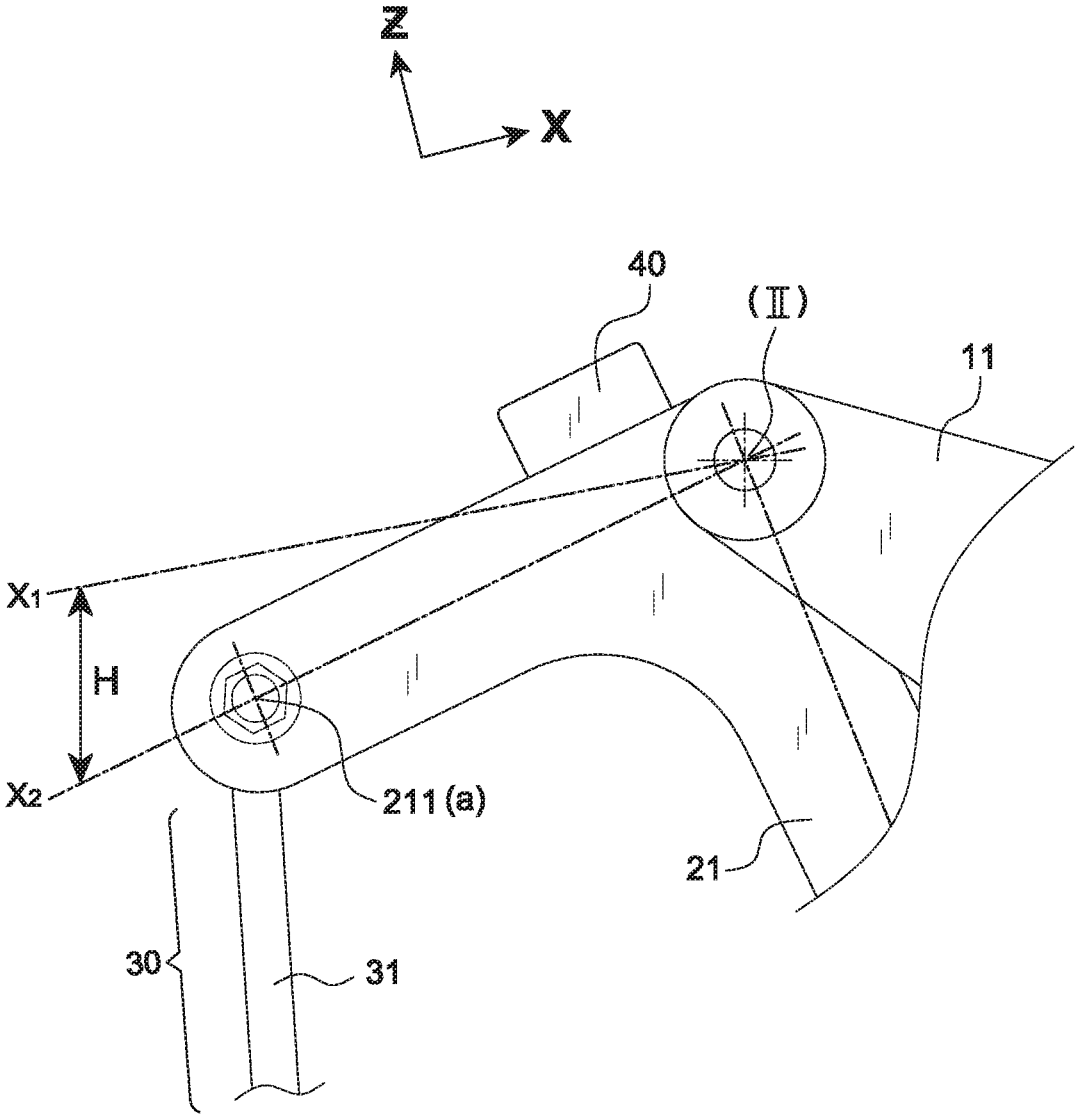
FIG. 3C is a third schematic diagram illustrating the motion tracking of the applicable embodiment of the present invention.

FIGS. 3A and 3B is schematic diagram illustrating the present invention detecting the exercise load, FIG. 3C is enlargement view of the position change. In FIG. 3A, the free end 241 of the driving rod 24 is not applied force, neither the connecting rod section 22,23 is moving, and the curved bar 21 is located in position X1. When the user applies force to the free end 241 of the driving rod 24, the connecting rod section 22,23 moved forward with a distance L, and the curved bar 21 goes down to the position X2 and has a height displacement (H); The applied force is proportional to the height displacement. Because the motion sensor 40 is secured on the curved bar 21, the motion sensor 40 is able to detect the height displacement (H) of the curved bar 21, and further get the exercise track (L) by calculating the height displacement (H). This is a clever combination of this motion sensor on exercise equipment to achieve the convenience and accuracy of measuring exercise track.

Figure 4:
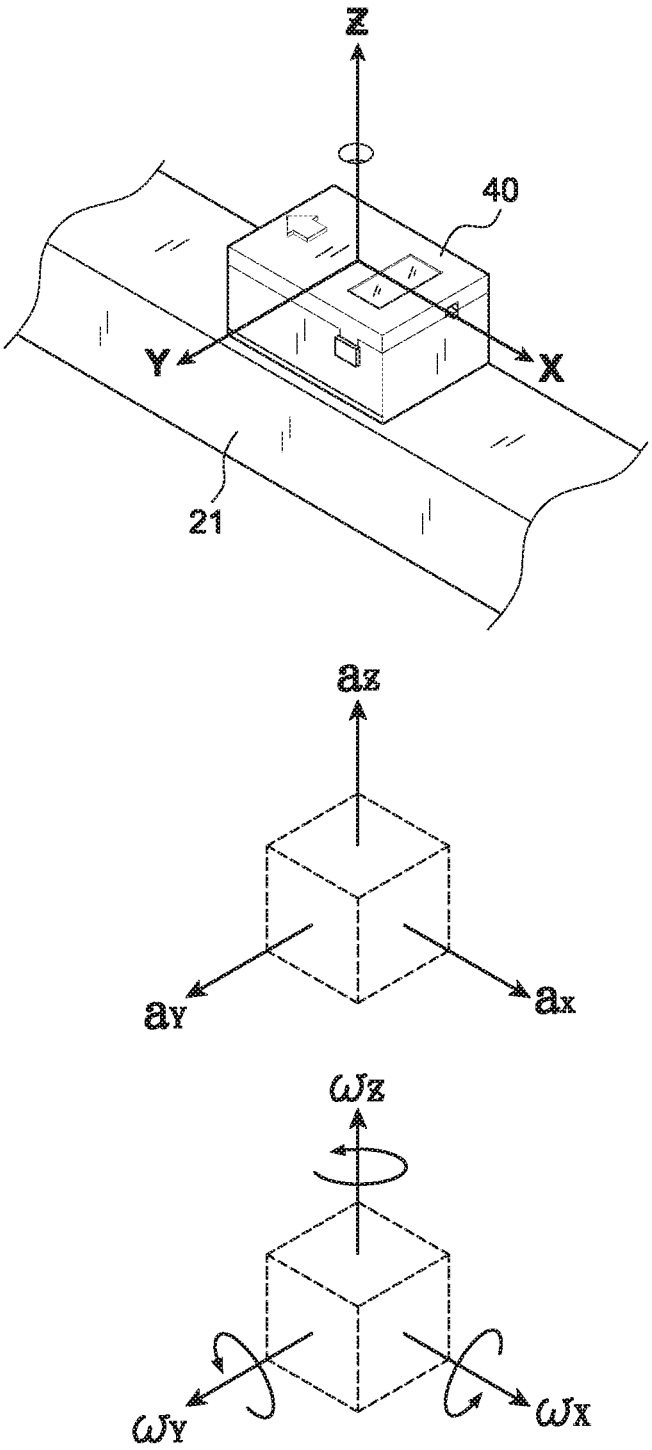
FIG. 4 is a schematic diagram illustrating the application principle of the motion sensor.
Figure 5:
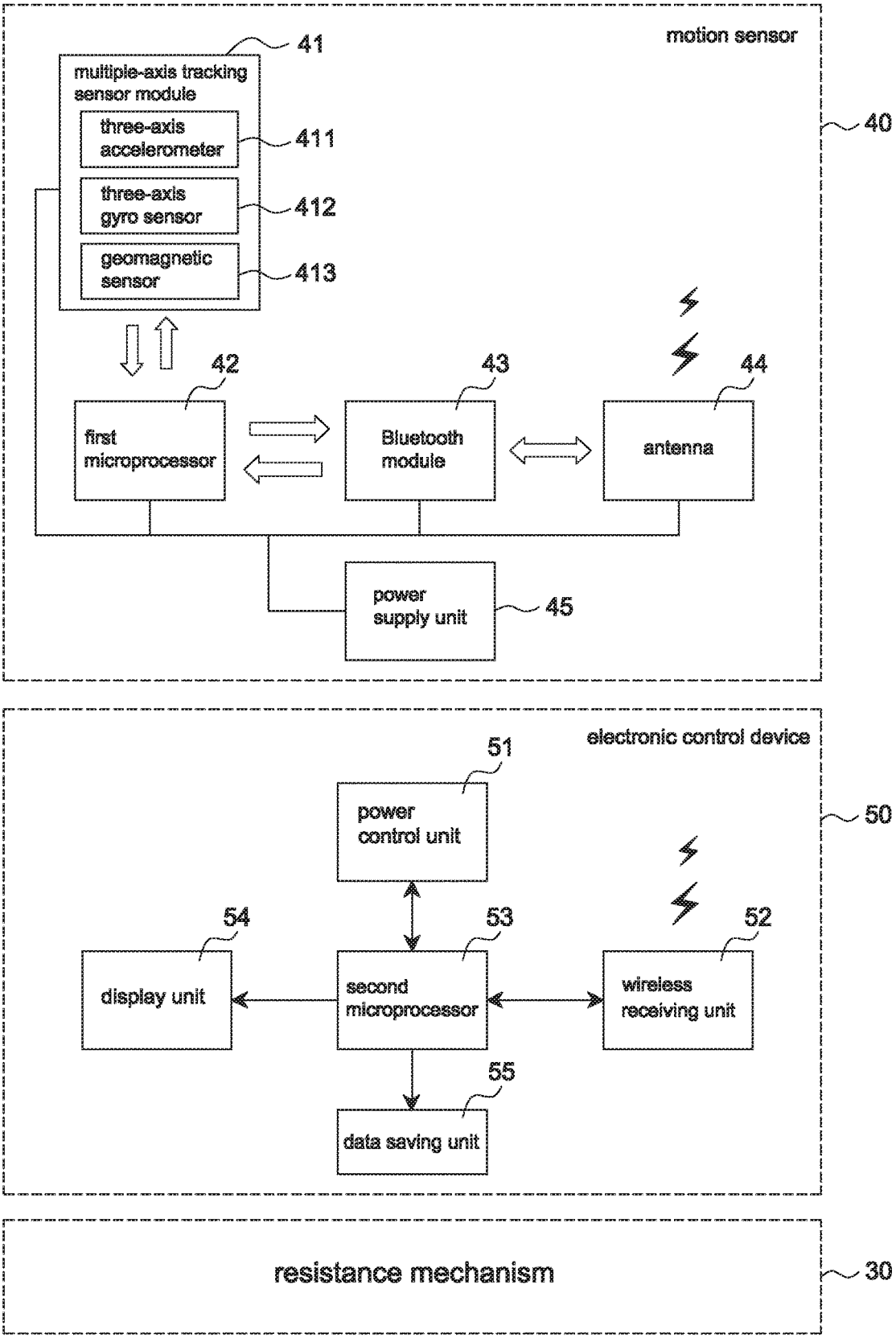
FIG. 5 is a block diagram illustrating the structure of the applicable embodiment.

FIG. 4 and FIG. 5 is a schematic diagram illustrating the application principle and structure of the motion sensor 40, inside the motion sensor 40 has a multiple-axis tracking sensor module 41 and a first microprocessor 42, said multiple-axis tracking sensor module 41 can include bot not limited: a three-axis accelerometer 411, a three-axis gyro sensor 412 for measuring acceleration (a) and angular velocity magnitude (ω), or a geomagnetic sensor 413. The multiple-axis tracking sensor module 41 uses the three-axis accelerometer 411 to sense three-axis motion which is the acceleration of exercising (ax, ay, az), and the three-axis gyro sensor 412 is used to sense three-axis rotation which is the angular velocity magnitude of exercising (ωX, ωY, ωZ); the geomagnetic sensor 413 detects the direction of geomagnetic to confirm the direction of the curved bar 24 to get the azimuth angle in absolute coordinate system of the curved bar 24 and further gets the height displacement (H) of the operating mechanism 20 during exercising.

In this embodiment, the first microprocessor 42 is electronically connected to the multiple-axis tracking sensor module 41, the first microprocessor 42 read the magnitude of the acceleration and the angular velocity from the multiple-axis tracking sensor module 41 in fixed time, and after operating, the magnitude become the signal of a height displacement; by the acceleration data which the multiple-axis tracking sensor module 41 provided, the microprocessor 42 calculate integral of acceleration (a) over time to get velocity, calculate integral of velocity over time to get displacement, and by the angular velocity data which the three-axis gyro sensor 412 provided, the first microprocessor 42 calculate the differential and the integral of the angular velocity (ω) to get angular acceleration and angle of rotation.

In this embodiment, the motion sensor 40 further comprises a Bluetooth module 43 arranged inside the motion sensor 40 and electrically connected to a first microprocessor 42, and the Bluetooth module 43 is coupled to an antenna 44 to transmit the motion tracking signal of the curved bar 24; furthermore, the motion sensor 40 further comprises a power supply unit 45 for providing power to the motion sensor 40; in this embodiment, the power supply unit 45 can be a battery, a charging circuit or a wall power socket.

In this embodiment, the electronic control device 50 further comprises a power control unit 51 for controlling the power, a wireless receiving unit 52 for receiving the motion tracking signal sent by the antenna 44 of the Bluetooth module 43, a second microprocessor 53 linked to a data saving unit 55 saving exercise type, exercise history or other information; a display unit 54 connecting to the second microprocessor 53, the second microprocessor 53 checks whether the motion track of the curved bar 24 fit the setting of the exercise track (L) or not, and shows the result on the display unit 54.

Based on the features disclosed above, the motion sensor 40 of the present invention sense the angular velocity and the height displacement of the operating mechanism 20 and further gets the exercise track (L) of the user, the size of the motion sensor 40 is small and does not take up space, and it is convenient to use and can precisely sensing the motion track.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An exercise machine using a motion sensor to track exercise, comprising:

an exercise equipment including a mainframe, the mainframe being fixed and will not be moved by a user's movement;

an operating mechanism arranged on the mainframe, the operating mechanism follows the movement of the user; and a resistance mechanism arranged on the mainframe and linked to the operating mechanism for providing an exercise load, the resistance mechanism having an oil pressure cylinder and an expansion link of the oil pressure cylinder coupled between the mainframe and the operating mechanism, wherein the operating mechanism includes a curved bar having a first pivot point and a second pivot point, an intermediate portion between the two pivot points is pivoted to the mainframe to form a first unmovable pivot end, a connecting rod section formed by a first connecting rod and a second connecting rod, a tail end of the first connecting rod is linked to the second pivot point of the curved bar and forms a first movable pivot point, between the first connecting rod and the second connecting rod forms a second movable pivot point, and a top of the second connecting rod is pivoted to the mainframe and forms a second unmovable pivot end, a driving rod having a free end to be movably driven by the user's movement and an opposing end linked to the second connecting rod for driving the connecting rod section, and the operating mechanism further includes a motion sensor affixed to the curved bar, the motion sensor having a multiple-axis tracking sensor module and a first microprocessor for detecting a displacement of the curved bar and transmitting a displacement signal to an electronic control device, the electronic control device includes a second microprocessor configured to process the received displacement signal to calculate a motion track of the user, wherein the bottom end of the oil pressure cylinder of the resistance mechanism is pivoted to the mainframe and forms a third unmovable pivot end, and the resistance mechanism further includes a brake lever, a top end of the brake lever is linked to the first pivot point of the curved bar and forms a third movable pivot point, and a bottom end of the brake lever is linked to the expansion link of the oil pressure cylinder, and whereby when the user applies force to the free end of the driving rod, the connecting rod section formed by first connecting rod and second connecting rod is moved forward by a distance, and the curved bar is displaced from a first position to a second position and has a height displacement, and since the applied force is proportional to the height displacement and the motion sensor is secured on the curved bar, the motion sensor is able to detect the height displacement of the curved bar by the multiple-axis tracking sensor module and the first microprocessor, to then transmit a height displacement signal to the electronic control device, and responsive to receipt of the height displacement signal, the second microprocessor is configured to calculate a distance value of displacement of the driving rod by the user.

2. The exercise machine using a motion sensor to track exercise as claimed in claim 1, wherein the motion sensor further comprises a Bluetooth module arranged inside the motion sensor and electrically connected to a first microprocessor, and the Bluetooth module is coupled to an antenna to transmit a motion tracking signal of the curved bar; furthermore, the motion sensor further comprises a power supply unit for providing power to the motion sensor.

3. The exercise machine using a motion sensor to track exercise as claimed in claim 2, wherein the electronic control device further comprises a power control unit for controlling the power, a wireless receiving unit for receiving the motion tracking signal sent by the antenna of the Bluetooth module, and a display unit connecting to the second microprocessor.

* * * * *